US007605682B2

(12) United States Patent
Nakao et al.

(10) Patent No.: US 7,605,682 B2
(45) Date of Patent: Oct. 20, 2009

(54) MAGNETIC CORE TYPE LAMINATED INDUCTOR

(75) Inventors: Fumiaki Nakao, Shizuoka (JP); Kazunari Suzuki, Shizuoka (JP); Mikio Kitaoka, Shizuoka (JP); Daisuke Matsubayashi, Shizuoka (JP); Shigenori Suzuki, Shizuoka (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 11/338,482

(22) Filed: Jan. 24, 2006

(65) Prior Publication Data

US 2006/0152325 A1 Jul. 13, 2006

Related U.S. Application Data

(63) Continuation of application No. PCT/JP2004/010752, filed on Jul. 22, 2004.

(51) Int. Cl.
*H01F 5/00* (2006.01)

(52) U.S. Cl. ..... 336/200

(58) Field of Classification Search ..... 336/200
See application file for complete search history.

(56) References Cited

U.S. PATENT DOCUMENTS 5,184,103 A * 2/1993 Gadreau et al. ..... 336/84 C
6,727,795 B2 * 4/2004 Sakakura et al. ..... 336/200

FOREIGN PATENT DOCUMENTS

| | | | |
|---|---|---|---|
| JP | 2-165607 | | 6/1990 |
| JP | 4-206905 | A | 7/1992 |
| JP | 04206905 | A * | 7/1992 |
| JP | 8-167523 | | 6/1996 |
| JP | 2000-182834 | | 6/2000 |
| JP | 2001-44037 | A | 2/2001 |
| JP | 2002-319508 | | 10/2002 |

* cited by examiner

*Primary Examiner*—Lincoln Donovan
*Assistant Examiner*—Joselito Baisa
(74) *Attorney, Agent, or Firm*—Harness, Dickey & Pierce, PLC

(57) ABSTRACT

In a magnetic core type laminated inductor, magnetic gap layers are interposed between layers of conductive patterns, and the magnetic gap layers are formed separately on multiple layers mutually distant from each other while sandwiching a magnetic body layer. Moreover, the multiple magnetic gap layers are vertically symmetrically disposed relative to a central portion of lamination in a magnetically equivalent fashion, and the respective magnetic gap layers interpose at least two layers of the conductive patterns therebetween.

6 Claims, 10 Drawing Sheets

(A-A CROSS SECTION WITH ENLARGED THICKNESS)

20-8

(CROSS SECTION WITH ENLARGED THICKNESS)

CURRENT/INDUCTANCE CHARACTERISTIC

MAGNETIC CORE TYPE LAMINATED INDUCTOR

CROSS-REFERENCE TO RELATED APPLICATIONS

This application is a continuation of the International Application No. PCT/JP2004/010752 filed on Jul. 22, 2004 designating the United States of America.

BACKGROUND OF THE INVENTION

1. Field of the Invention

The present invention relates to a magnetic core type laminated inductor. More specifically, the present invention is effective for application to a surface mounting chip inductor used in the state of direct-current superposition, and is suitable for application to a micro DC-DC converter in a mobile information device such as a mobile telephone, which is configured to convert a power supply voltage (an electromotive force) obtained from an internal battery into a given circuit operating voltage.

2. Description of the Related Art

Magnetic core type inductors such as transformers or choke coils used in power circuits including DC-DC converters and the like are formed by winding coils around magnetic cores. Therefore, it has been difficult to achieve downsizing, or more particularly, to achieve thinner profiles of the inductors as compared to electronic components such as semiconductor integrated circuits. Accordingly, the inventors of the present invention have studied a magnetic core type laminated inductor as shown in FIGS. 9A to 9D.

FIGS. 9A to 9D show a configuration of a magnetic core type laminated inductor for which the inventors have studied prior to the present invention. Of these drawings, FIG. 9A is a perspective view of an external configuration, FIG. 9B is a top plan view of conductive patterns, FIG. 9C is a cross-sectional view taken along A-A line in FIG. 9B, and FIG. 9D is an enlarged view in a thickness direction of FIG. 9C, respectively.

A non-magnetic core type laminated inductor, which has no magnetic core, is formed by laminating a non-magnetic electrical insulating layer and conductive patterns by screen printing or the like, whereas a magnetic core type laminated inductor 10*b* shown in FIGS. 9A to 9D is formed by laminating electrical insulating magnetic bodies (soft magnetic bodies) 30 and conductive patterns 20 by screen printing or the like. The conductive patterns 20 overlap in the direction of the layer in the electrical insulating magnetic bodies 30, thereby forming a coil L that extends spirally. The laminated electrical insulating magnetic bodies 30 form a closed magnetic circuit that guides magnetic fluxes (shown by the arrows in the drawing) from the coil L annularly. Both ends of the coil L are connected to electrode terminals 11 and 12 located on both ends of an inductor chip through lead conductive pattern portions 21 and 22.

The magnetic core type laminated inductor 10*b* includes the magnetic core made of the magnetic bodies 30, and is therefore capable of reducing magnetic leakage and obtaining necessary inductance with relatively a small number of turns of the coil. For this reason, this configuration is suitable for forming the above-mentioned transformer or choke coil into a micro chip inductor. For example, in terms of a chip inductor used for a high frequency switching DC-DC converter, the configuration can deal with almost any specification requirements with about 4 turns of the coil in combination with the magnetic bodies 30 having high magnetic permeability.

Here, other publicly known technical examples relatively close to the studied technique include laminated inductors disclosed in Japanese Patent Application Laid-open Publications Nos. 2003-31424 and 2001-85231, for instance.

The magnetic core type laminated inductor 10*b* can obtain high inductance as compared to the number of turns of the coil. However, the inductor has a problem that the inductance rapidly drops even at a small coil current (an exciting current) due to magnetic saturation of the magnetic bodies 30. In other words, the inductor has a problem that it is not possible to achieve a sufficient rated current as a transformer or a choke coil because of a small current upper limit that can assure the inductance equal to or above a given level.

An inductor applied to a supply circuit or a power circuit such as a DC-DC converter is often used in the state of direct-current superposition, i.e. while superposing direct currents. It is necessary to ensure the rated current to a sufficiently large level in order to obtain a given inductance characteristic in the state of direct-current superposition.

Therefore, the inventors have studied a technique to enhance a magnetic saturation level of the closed magnetic circuit by interposing a magnetic gap layer 40 in the closed magnetic circuit as shown in FIGS. 10A and 10B, and thereby to increase the rated current.

Of FIGS. 10A and 10B, FIG. 10A shows a cross-sectional view enlarged in the thickness of the magnetic core type laminated inductor 10*b* and FIG. 10B shows a current/inductance characteristic graph of the inductor 10*b*, respectively.

As shown in FIG. 10A, the magnetic core type laminated inductor 10*b* illustrated in the drawing includes four layers (20*a* to 20*d*) of conductive patterns 20 formed in the magnetic bodies 30 having high magnetic permeability. The four-layered conductive patterns (20*a* to 20*d*) form a coil having four turns. The magnetic gap layer 40 is formed in a central layer portion so as to bisect the four-layered conductive patterns (20*a* to 20*d*) in the direction of the layers. Since this magnetic gap layer 40 is interposed in the closed magnetic circuit, it is possible to enhance the magnetic saturation level in the closed magnetic circuit.

In this way, as shown in FIG. 10B, it is possible to ensure a high current upper limit, i.e. a large rated current which can assure an inductance value equal to or above a given level. In the graph shown in FIG. 10B, a solid line shows a characteristic when the magnetic gap layer 40 is present, and a dashed line shows a characteristic when the magnetic gap layer 40 is absent.

The magnetic core type laminated inductor 10*b* shown in FIG. 10A can increase the rated current so as to assure the inductance value equal to or above the given level by use of the magnetic gap layer 40. However, the following problems are found out.

Specifically, in terms of FIG. 10B, variation in inductance attributable to the coil current is relatively gentle in a region where the coil current (the exciting current) is larger than a certain level. However, the inductance is distinctively high in a region where the coil current is small, and the variation attributable to the coil current is steep and the characteristic is not stable. Accordingly, in the case of using the inductor while superposing direct currents, the inductor poses a problem that the superimposed current suffers significant fluctuation of the inductance and a favorable performance of direct-current superposition can be therefore obtained.

Meanwhile, it is usually effective to carry out measurement and inspection of the inductance at a small current in light of reduction in a burden of measurement and enhancement in inspection efficiency. However, the inspection at a small current measures the distinctively high inductance as well. Accordingly, there is also a problem of incapability to carry out correct inspection.

To the knowledge of the inventors, the following is a conceivable reason of the distinctively high inductance at the small current region. Specifically, locally closed magnetic circuits are formed around the respective conductive patterns (20*a* to 20*d*) as indicated with arrows in FIG. 10A. Due to interposition of the magnetic gap layer 40, the closed magnetic circuits having relatively low magnetic permeability are locally formed around the inner conductive patterns 20*b* and 20*c* adjacent to the magnetic gap layer 40. Meanwhile, due to absence of interposition of the magnetic gap layer 40, the closed magnetic circuits having relatively high magnetic permeability are locally formed around the outer conductive patterns 20*a* and 20*d* distant from the magnetic gap layer 40. For this reason, induced magnetic fluxes from the respective conductive patterns are not mutually balanced and cancelled between the inner conductive pattern 20*b* or 20*c* and the outer conductive pattern 20*a* or 20*d*, and a local magnetic bias is thereby generated. It is conceivable that local magnetic saturation generated by this magnetic bias causes the distinctively high inductance as shown in FIG. 10B.

SUMMARY OF THE INVENTION

An object of the present invention is to provide a magnetic core type laminated inductor which is capable of ensuring a large rated current that can assure an inductance value equal to or above a given level, of obtaining a favorable characteristic of relatively gentle variation of inductance in the entire current region within a rated range and thereby obtaining a favorable direct-current superposition characteristic, and moreover, of allowing correct measurement and inspection at a small current.

To attain the above and other objects, a laminated inductor according to an aspect of the present invention is a magnetic core type laminated inductor comprising electrically insulating magnetic bodies; conductive patterns laminated with the magnetic bodies vertically to form a coil revolving spirally, the conductive patterns overlapping vertically in the magnetic bodies, the magnetic bodies forming a closed magnetic circuit guiding a magnetic field from the coil. Here, magnetic gap layers are interposed between layers of the conductive patterns. The magnetic gap layers are formed separately on a plurality of layers mutually distant from each other while sandwiching a magnetic body layer. Moreover, the plurality of magnetic gap layers are vertically symmetrically disposed relative to a central portion of lamination in a magnetically equivalent fashion, and the respective magnetic gap layers interpose at least two layers of the conductive patterns between the magnetic gap layers.

The magnetic core type laminated inductor may also satisfy or is expected to satisfy any one or a combination of the following aspects (1) to (6), namely:

(1) the magnetic body layer is located at the central portion of lamination and the plurality of magnetic gap layers are vertically symmetrically disposed in the magnetically equivalent fashion while sandwiching the magnetic body layer at the central portion;

(2) the conductive patterns for constituting the coils are made of the layers in an even number, and the plurality of magnetic gap layers are vertically symmetrically disposed in the magnetically equivalent fashion respectively above and below the magnetic body layer at the central portion which vertically bisects the conductive pattern layers in the even number;

(3) the coil is made of the conductive patterns of four layers, and the magnetic gap layers are disposed respectively between first and second layers of the conductive patterns and between third and fourth layers of the conductive patterns;

(4) the magnetic bodies are made of a ferrite magnetic material;

(5) the magnetic gap layer is made of any of a non-magnetic material and a magnetic material having relatively low magnetic permeability and a high saturation characteristic as compared to the magnetic bodies; and (6) the magnetic gap layers are formed on an overlapping surface with the spirally revolving conductive patterns and on an inner side surface thereof, and side end surfaces of the magnetic gap layers are surrounded by the magnetic bodies.

Features and objects of the present invention other than the above will become clear by reading the description of the present specification with reference to the accompanying drawings.

BRIEF DESCRIPTION OF THE DRAWINGS

FIGS. 1A to 1C show a configuration of a magnetic core type laminated inductor of a first implementation of the present invention, in which FIG. 1A is a perspective view showing an external configuration, FIG. 1B is a top plan view showing conductive patterns, and FIG. 1C is a cross-sectional view taken along the A-A line in FIG. 1B while emphasizing and enlarging the cross section in the thickness direction.

FIGS. 3A to 3C show configurations of a magnetic core type laminated inductor of a second implementation of the present invention, a magnetic core type laminated inductor of a third implementation thereof, and a magnetic core type laminated inductor of a comparative example, in which FIG. 3A is a cutaway perspective view of the respective magnetic core type laminated inductors of the second implementation, the third implementation, and the comparative example, FIG. 3B is a cutaway perspective view of the magnetic core type laminated inductor of the second implementation, and FIG. 3C is a cutaway perspective view of the magnetic core type laminated inductor of the third implementation.

FIGS. 5A to 5D show configurations of magnetic core type laminated inductors of fourth to sixth implementations of the present invention, and a magnetic core type laminated inductor of a comparative example, in which FIG. 5A is a cutaway perspective view of the magnetic core type laminated inductor of the comparative example with an emphasis on the thickness direction, FIG. 5B is a cutaway perspective view of the magnetic core type laminated inductor of the fourth implementation, FIG. 5C is a cutaway perspective view of the magnetic core type laminated inductor of the fifth implementation, and FIG. 5D is a cutaway perspective view of the magnetic core type laminated inductor of the sixth implementation.

FIGS. 6A to 6C are characteristic diagrams of the magnetic core type laminated inductor of the comparative example and the magnetic core type laminated inductors of the fourth to sixth implementations, in which FIG. 6A is a graph showing current/inductance characteristics of the magnetic core type laminated inductors of the comparative example and the sixth implementation, FIG. 6B is a graph showing current/inductance characteristics of the magnetic core type laminated inductors of the sixth and fourth implementations, and FIG. 6C is a graph showing current/inductance characteristics of the magnetic core type laminated inductors of the fourth and fifth implementations.

FIGS. 7A and 7B are views concerning a magnetic core type laminated inductor of a seventh implementation of the present invention, in which FIG. 7A is an exploded perspective view of the magnetic core type laminated inductor of the seventh implementation with an emphasis on the thickness direction, and FIG. 7B is a graph showing a current/inductance characteristic of the magnetic core type laminated inductor of the seventh implementation.

FIGS. 8A to 8C show configurations of magnetic core type laminated inductors of eighth to tenth implementations of the present invention, in which FIG. 8A is a cutaway perspective view of the magnetic core type laminated inductor of the eighth implementation with an emphasis on the thickness direction, FIG. 8B is a cutaway perspective view of the magnetic core type laminated inductor of the ninth implementation with an emphasis on the thickness direction, and FIG. 8C is a cutaway perspective view of the magnetic core type laminated inductor of the tenth implementation with an emphasis on the thickness direction FIGS. 9A to 9D show a configuration of a magnetic core type laminated inductor for which the inventors have studied prior to the present invention as a comparative example to a magnetic core type laminated inductor of the present invention, in which FIG. 9A is a perspective view showing an external configuration of the magnetic core type laminated inductor of the comparative example, FIG. 9B is a top plan view showing conductive patterns of the magnetic core type laminated inductor of the comparative example, FIG. 9C is a cross-sectional view taken along the A-A line in FIG. 9B, and FIG. 9D is a cross-sectional view of FIG. 9C with an emphasis on the thickness direction.

FIGS. 10A and 10B show a modified example of the magnetic core type laminated inductor of the comparative example shown in FIGS. 9A to 9D, in which FIG. 10A is a cross-sectional view enlarged in the thickness direction of a magnetic core type laminated inductor 10*b* formed by providing the magnetic core type laminated inductor of the comparative example with a magnetic gap layer, and FIG. 10B is a graph showing a current/inductance characteristic of the inductor 10*b* formed by providing the magnetic core type laminated inductor of the comparative example shown in FIGS. 9A to 9D with the magnetic gap layer.

For more complete understandings of the present invention and the advantages thereof, reference should be made to the following description in conjunction with the accompanying drawings.

DETAILED DESCRIPTION OF THE INVENTION

At least the following matters will be made clear by the explanation in the present specification and the description of the accompanying drawings.

Figure 1A:
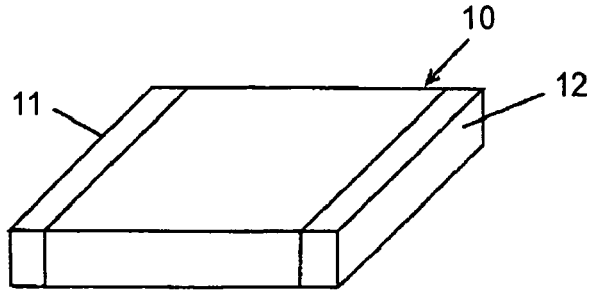
Figure 1B:
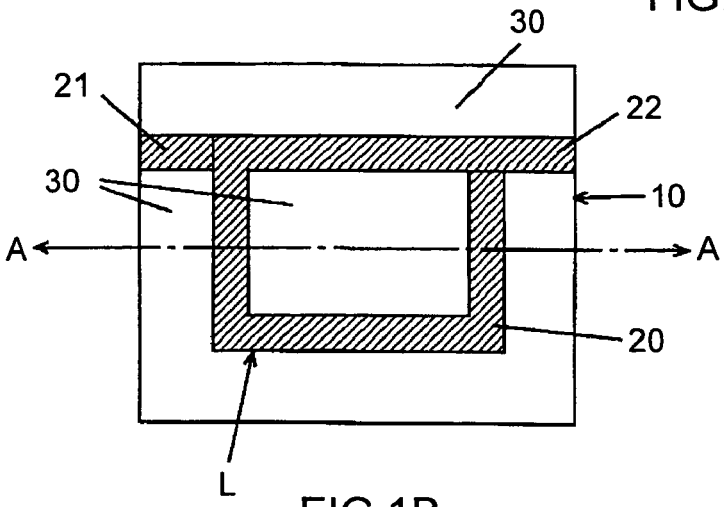
Figure 1C:
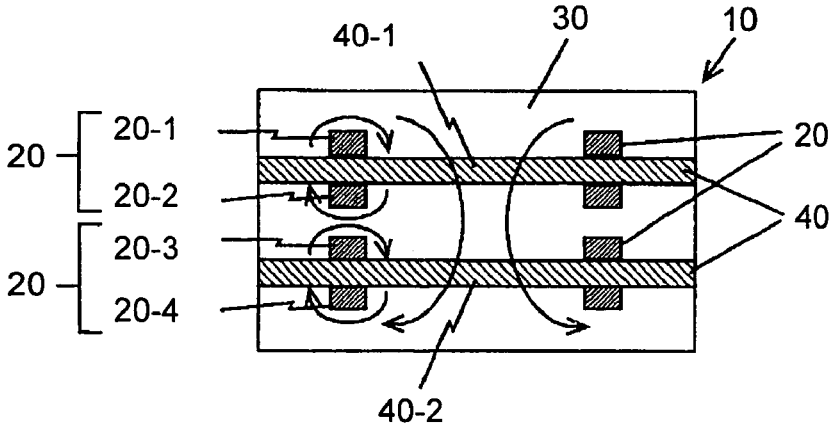

FIGS. 1A to 1C show a configuration of a magnetic core type laminated inductor of a first implementation of the present invention, in which FIG. 1A is a perspective view showing an external configuration, FIG. 1B is a top plan view showing conductive patterns, and FIG. 1C is a cross-sectional view taken along the A-A line in FIG. 1B while emphasizing and enlarging the cross section in the thickness direction.

A magnetic core type laminated inductor 10 shown in the drawings is formed as a surface mounting chip component. This magnetic core type laminated inductor 10 is formed by laminating electrical insulating magnetic bodies (soft magnetic bodies) 30 and conductive patterns 20 alternately by screen printing or the like. The conductive patterns 20 overlap in the layer direction in the electrical insulating magnetic bodies 30 and form a coil L that revolves spirally. In the case of the illustrated implementation, the conductive patterns 20 are bent perpendicularly and form the coil L which is wound in a rectangular shape.

The laminated electrical insulating magnetic bodies 30 form a closed magnetic circuit that guides magnetic fluxes (arrows in the drawing) from the coil L annularly. Both ends of the coil L are connected to electrode terminals 11 and 12 located on both ends of an inductor chip through lead conductive pattern portions 21 and 22.

Here, as shown in FIG. 1C, the coil includes four turns by use of the conductive patterns (20*a* to 20*d*) of four layers (an even number). Moreover, two layers of magnetic gap layers 40 and 40 are formed separately in the magnetic bodies 30.

One of the magnetic gap layers 40 is interposed between first and second layers of the conductive patterns (20*a* and 20*b*). The other magnetic gap layer 40 is interposed between third and fourth layers of the conductive patterns (20*c* and 20*d*).

Since the conductive patterns (20*a* to 20*d*) include layers in an even number (four layers), a magnetic body layer is located at a central portion of lamination. The two magnetic gap layers 40 and 40 are formed as the mutually separate two layers while sandwiching the magnetic body layer at the central portion of lamination, and are disposed vertically symmetrically relative to the central portion of lamination in a magnetically equivalent fashion. The two conductive patterns (20*b* and 20*c*) are located between the upper and lower magnetic gap layers 40.

The magnetic bodies 30 are made of a ferrite magnetic material. Meanwhile, the magnetic gap layers 40 and 40 are made of a non-magnetic material. Although the magnetic gap layers 40 and 40 apply the non-magnetic material in the implementation, it is also possible to apply a magnetic material having relatively low magnetic permeability and a high saturation characteristic to the magnetic bodies 30.

Figure 2:
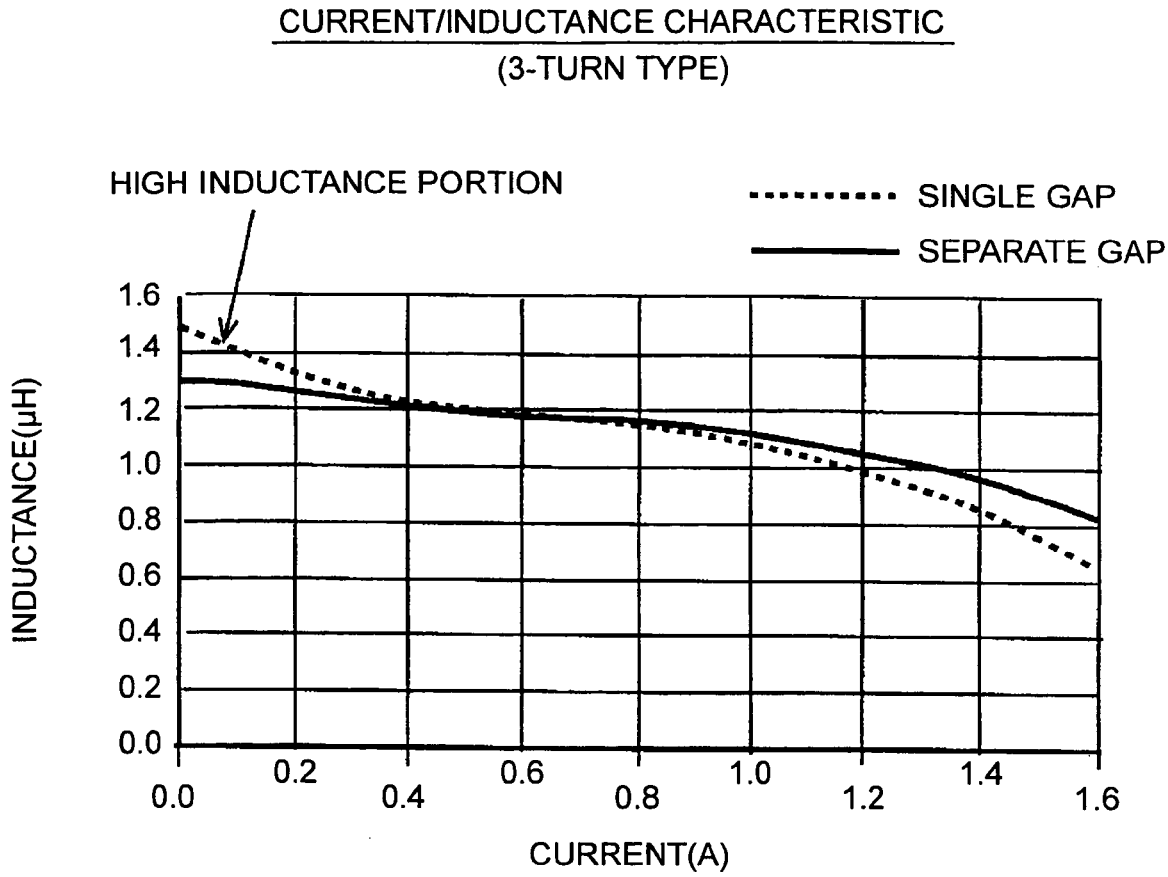
FIG. 2 is a view showing an example of a current/inductance characteristic of the magnetic core type laminated inductor in terms of the first implementation of the present invention.
Figure 10A:
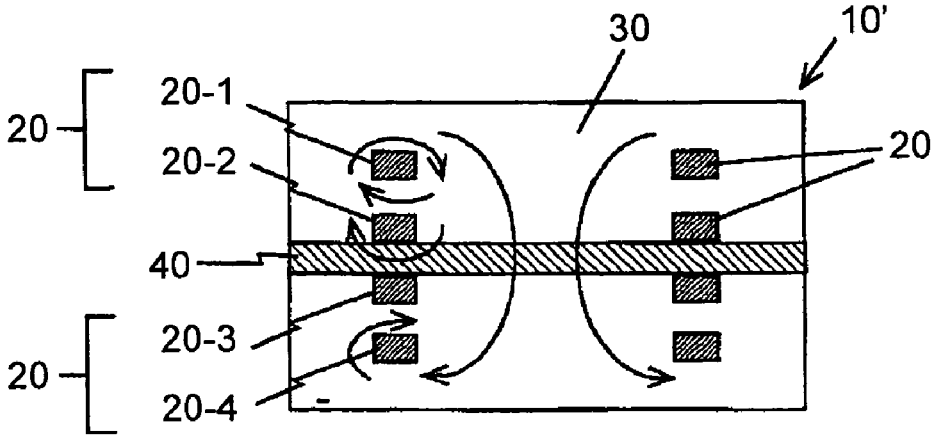
Figure 10B:
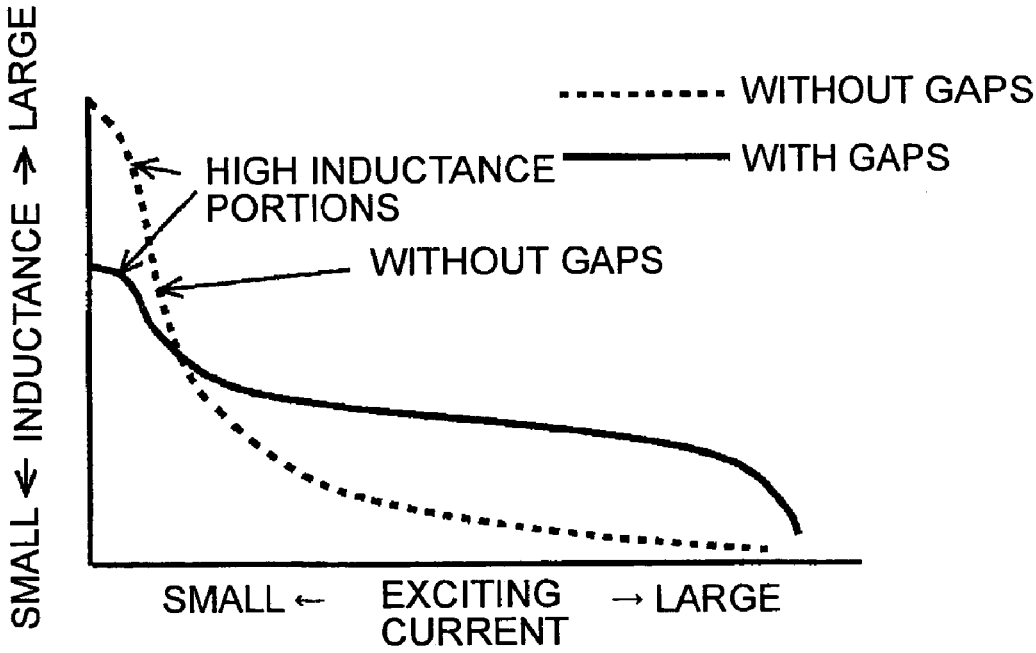

FIG. 2 shows a current/inductance characteristic of the magnetic core type laminated inductor 10. In the drawing, a characteristic indicated with a solid line shows a characteristic of the magnetic core type laminated inductor 10 of the implementation illustrated in FIGS. 1A to 1C. A dashed line shows a characteristic of the magnetic core type laminated inductor 10*b* shown in FIG. 10A. As it is apparent from the drawing, a large amount of a rated current capable of assuring inductance equal to or above a given level is ensured in either case. Meanwhile, the implementation shows a favorable current/inductance characteristic with a gentle curve and small variation in terms of the entire range of the rated current without causing a distinctively high level of inductance in a small current region.

Such a favorable characteristic is achieved by the following structural features, namely:

(1) the magnetic gap layers 40 and 40 are interposed between the layers of conductive patterns (20*a* to 20*d*);

(2) the magnetic gap layers 40 are formed separately into multiple layers which are distant from each other while sandwiching the magnetic body layer;

(3) the magnetic gap layers 40 and 40 of the multiple layers are disposed vertically symmetrically relative to the central portion of lamination; and (4) The respective magnetic gap layers 40 and 40 are disposed so as to interpose at least two layers of the conductive patterns (20*b* and 20*c*) therebetween.

From these structural features, the inductance in the small current regions seems to be flattened by the following reasons.

Specifically, as shown in the magnetic flux lines indicated with arrows in FIG. 1C, when the magnetic gap layers 40 are respectively provided in a space between the conductive patterns 20*a* and 20*b* and in a space between the conductive patterns 20*c* and 20*d*, local magnetic fluxes flowing in a plane direction (a horizontal direction) through the space between the conductive patterns 20*a* and 20*b*, and between the conductive patterns 20*c* and 20*d* are blocked by the magnetic gap layers 40. That is, local magnetic fluxes flowing through the winding are eliminated. Meanwhile, the central portion of lamination, i.e. a space between the two pairs of conductive patterns (the pair of 20*a* and 20*b* and the pair of 20*c* and 20*d*) is the magnetic body layer. Local magnetic fields generated respectively above and below the central magnetic body layer are cancelled on the magnetic body layer at the central portion because the magnetic fields of the same size act in mutually opposite directions. In this way, there is no leakage of magnetic fluxes out of the winding. As a result, there are no magnetic fluxes flowing through all the winding in the plane direction. Accordingly, the distinctive impedance variation is suppressed.

Based on this idea, the configuration to form the coil with the conductive patterns (20*a* to 20*d*) of four layers and to dispose the magnetic gap layers 40 and 40 respective in the space between the first and second layers of the conductive patterns (20*a* and 20*b*) and in the space between the third and fourth layers of the conductive patterns (20*c* and 20*d*) seems to be optimal. The result shown in FIG. 2 confirms this fact.

The multiple layers of the magnetic gap layers 40 and 40 are vertically symmetrically disposed relative to the central portion of lamination in the magnetically equivalent fashion. Here, as described in the implementation, the vertically symmetrical layout in the magnetically equivalent fashion can be formed by the vertically symmetrical layout in terms of the shape and dimensions. Nevertheless, the effect is achieved by the vertically symmetrical layout in the magnetically equivalent fashion, and it is not always necessary to satisfy the vertically symmetrical layout in terms of the shape and dimensions.

As described above, the magnetic core type laminated inductor 10 of the implementation can ensure a large rated current capable of assuring an inductance value equal to or above a given level and achieve a favorable characteristic of relatively gentle variation of inductance in the entire current region within the rated range. In this way, it is possible to obtain a favorable direct-current superposition characteristic. Moreover, it is also possible to perform correct measurement and inspection at a small current.

The above-described first implementation is one of the best modes for carrying out the present invention. However, it is also possible to obtain the given effect by other implementations of the present invention.

Figure 3A:
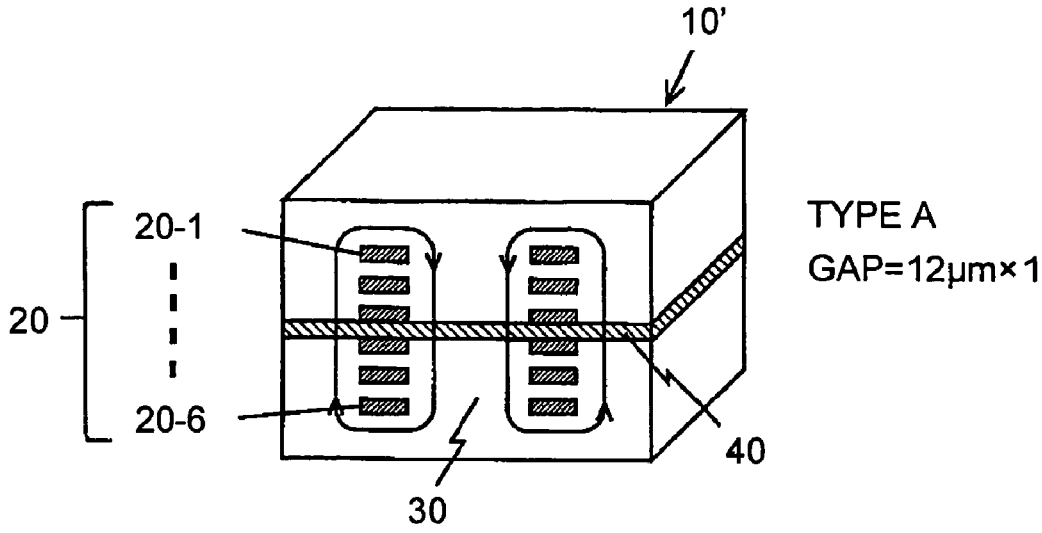
Figure 3B:
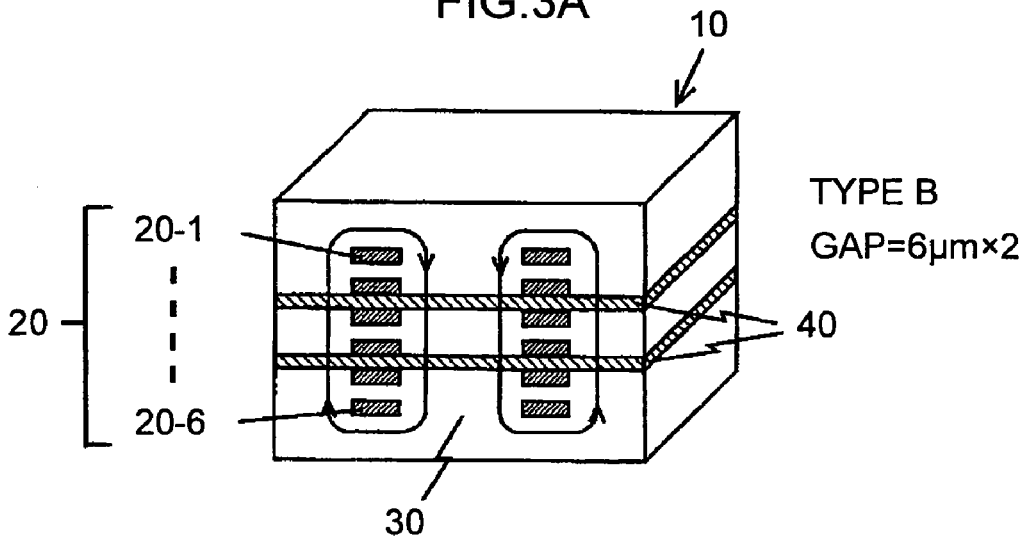
Figure 3C:
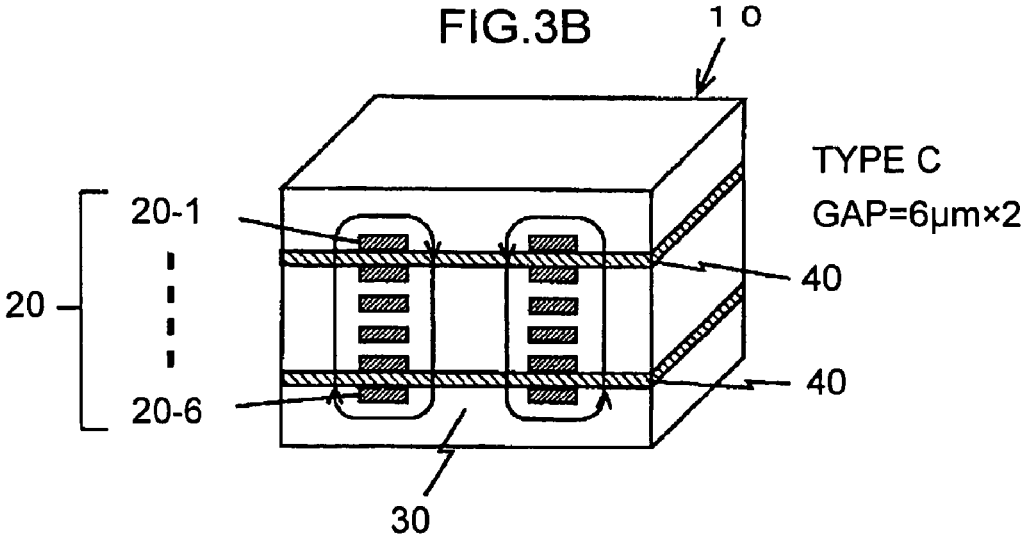

FIGS. 3A to 3C show magnetic core type laminated inductors of second and third implementations of the present invention together with a comparative example. In terms of these drawings, FIGS. 3A, 3B, and 3C are cutaway perspective views of the magnetic core type laminated inductors enlarged and emphasized in the thickness direction. Of these drawings, FIG. 3A shows the comparative example, FIG. 3B shows the second implementation, and FIG. 3C shows the third implementation, respectively.

In any of the magnetic core type laminated inductor 10*b* of the comparative example and the magnetic core type laminated inductors 10 of the implementations, a coil having 5.5 turns is formed by laminating conductive patterns (20*a* to 20*f*) of six layers.

The laminated inductor 10*b* of the comparative example shown in FIG. 3A includes just one layer of the magnetic gap layer 40 (12 μm) having a relatively large thickness, which is formed at a central portion vertically bisecting the six layers of conductive patterns (20*a* to 20*f*). This comparative example will be defined as Type A.

The laminated inductor 10 of the second implementation shown in FIG. 3B includes the magnetic gap layers 40 (6 μm) having relatively a small thickness, which are formed respectively in a space between a second and a third layer from the top and in a space between a second layer and a third layer from the bottom among conductive patterns (20*a* to 20*f*) of six layers. The two magnetic gap layers 40 and 40 are vertically symmetrically disposed in the magnetically equivalent fashion while sandwiching the magnetic body layer at the central portion of lamination. Moreover, two conductive pattern layers are disposed between the two magnetic gap layers 40 and 40. This implementation will be defined as Type B.

The laminated inductor 10 of the third implementation shown in FIG. 3C includes the magnetic gap layers 40 (6 μm) having relatively the small thickness, which are formed respectively in a space between a first layer and the second layer from the top and in a space between a first layer and a second layer from the bottom among the six layers of conductive patterns (20*a* to 20*f*). The two magnetic gap layers 40 and 40 are vertically symmetrically disposed in the magnetically equivalent fashion while sandwiching the magnetic body layer at the central portion of lamination. Moreover, four conductive pattern layers are disposed between the two magnetic gap layers 40 and 40. This implementation will be defined as Type C.

In this case, the number of turns of the coil is equal to 5.5 turns instead of 6 turns relative to the six layers of conductive patterns. This is because the electrode terminals 11 and 12 for connecting both lead ends of the winding are located on mutually opposite surfaces. In this way, the number of turns does not satisfy the vertical symmetry in terms of the shape and dimensions. However, as described previously, it is satisfactory as long as the vertical symmetry is ensured in the magnetically equivalent fashion. Moreover, interlayer connecting means for connecting the conductive patterns on the respective layers by use of through holes is required to realize a laminated coil, and positions of interlayer connection between the respective layers must be shifted depending on the layers to avoid overlapping. For this reason, in a strict sense, the vertical symmetry is not achieved on the both sides of the central portion as a consequence. However, it is satisfactory if the vertical symmetry is achieved in the magnetically equivalent fashion to the extent that can obtain the above-described effect practically.

Figure 4:
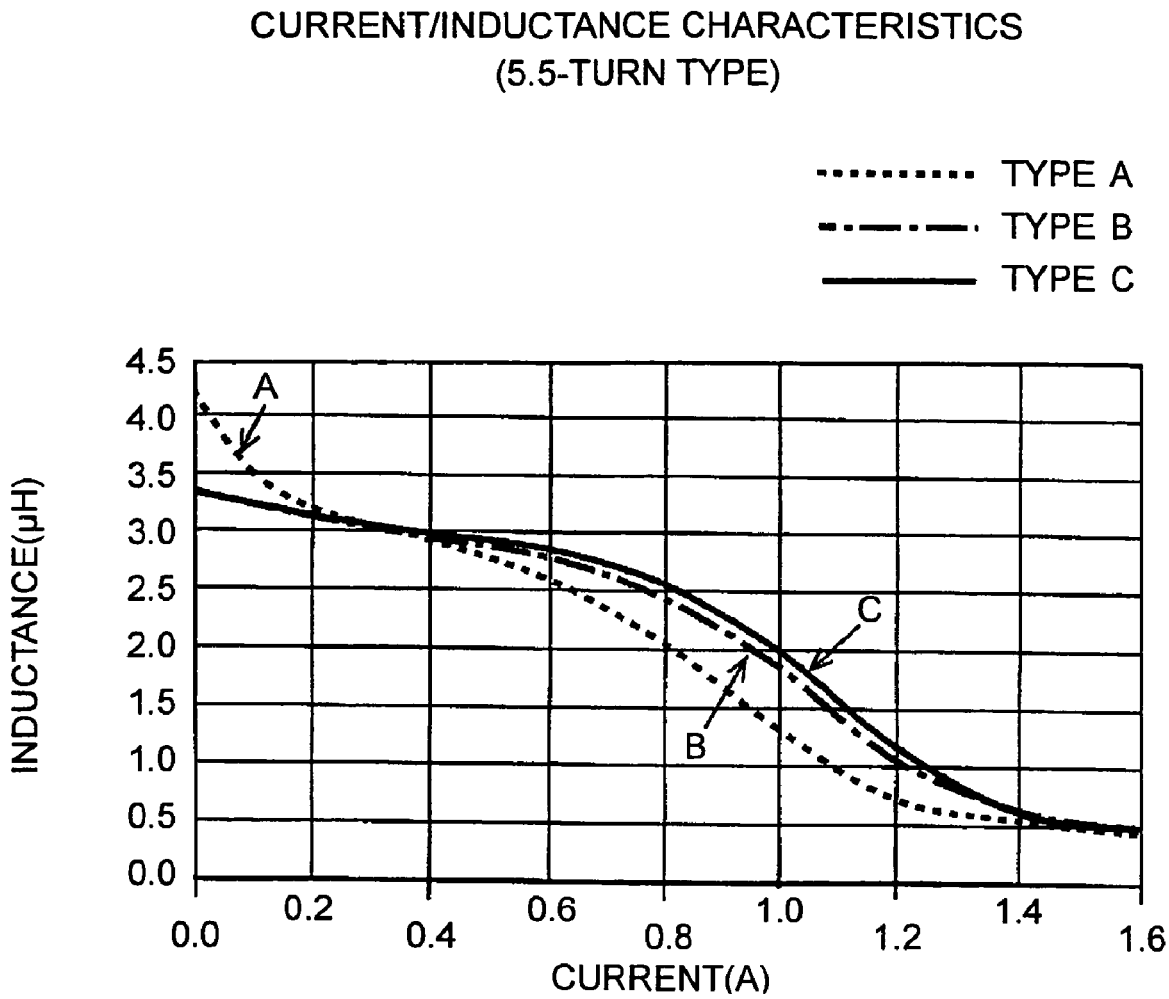
FIG. 4 is a view showing current/inductance characteristics of the magnetic core type laminated inductor of the second implementation of the present invention, the magnetic core type laminated inductor of the third implementation thereof, and the magnetic core type laminated inductor of the comparative example.

FIG. 4 shows current/inductance characteristics of the three Types A, B, and C, respectively. As it is apparent from the drawing, Types B and C representing the second and third implementations achieve favorable characteristics having relatively gentle inductance variation in the entire current regions within the rated range as compared to Type A representing the comparative example. Meanwhile, when Type B is compared with Type C, Type C representing the third implementation can achieve a higher inductance retaining capability at a large current region and it is therefore possible to obtain a more favorable characteristic.

Figure 5A:
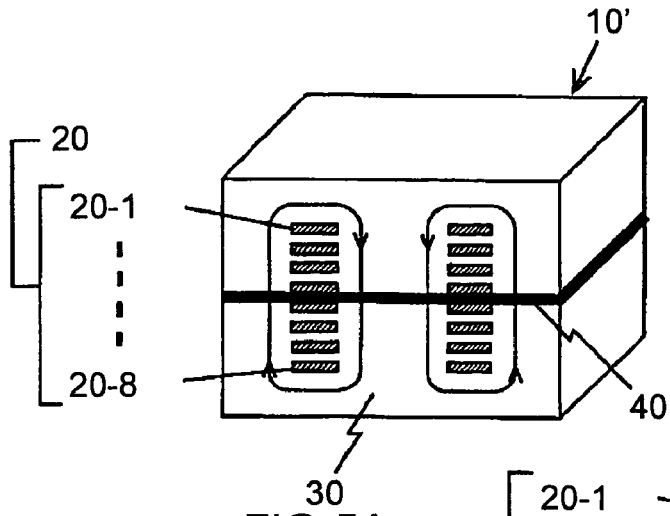
Figure 5B:
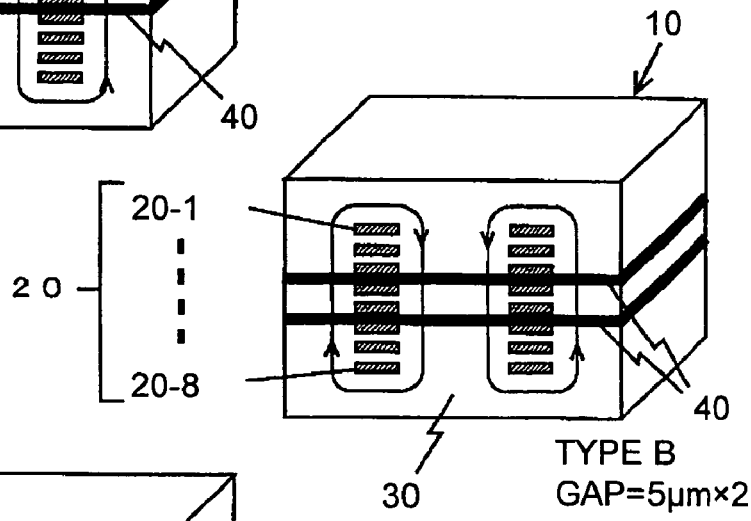
Figure 5C:
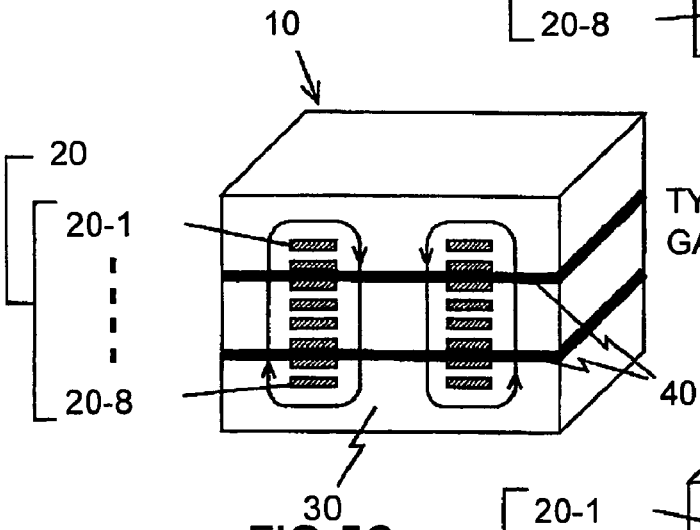
Figure 5D:
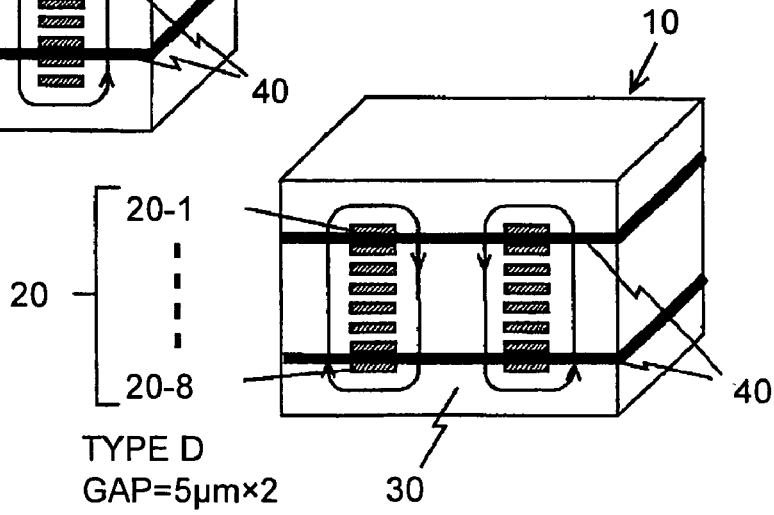

FIGS. 5A to 5D show magnetic core type laminated inductors of fourth to sixth implementations of the present invention together with a comparative example. In terms of these drawings, FIGS. 5A to 5D are cutaway perspective views of the magnetic core type laminated inductors enlarged and emphasized in the thickness direction. Of these drawings, FIG. 5A shows the comparative example, FIG. 5B shows the fourth implementation, FIG. 5C shows the fifth implementation, and FIG. 5D shows the sixth implementation, respectively.

In any of the magnetic core type laminated inductor 10*b* of the comparative example and the magnetic core type laminated inductors 10 of the implementations, a coil having 7.5 turns is formed by laminating eight layers of conductive patterns (20*a* to 20*h*).

The laminated inductor 10*b* of the comparative example shown in FIG. 5A includes just one layer of the magnetic gap layer 40 (10 μm) having a relatively large thickness, which is formed at a central portion vertically bisecting the eight layers of conductive patterns (20*a* to 20*h*). This comparative example will be defined as Type A.

The laminated inductor 10 of the fourth implementation shown in FIG. 5B includes the magnetic gap layers 40 (5 μm) having relatively a small thickness, which are formed respectively in a space between a third layer and a fourth layer from the top and in a space between a third layer and a fourth layer from the bottom among eight layers of conductive patterns (20*a* to 20*h*). The two magnetic gap layers 40 and 40 are vertically symmetrically disposed in the magnetically equivalent fashion while sandwiching the magnetic body layer at the central portion of lamination. Moreover, two conductive pattern layers are disposed between the two magnetic gap layers 40 and 40. This implementation will be defined as Type B.

The laminated inductor 10 of the fifth implementation shown in FIG. 5C includes the magnetic gap layers 40 (5 μm) having relatively the small thickness, which are formed respectively in a space between a second layer and a third layer from the top and in a space between a second layer and a third layer from the bottom among the eight layers of conductive patterns (20*a* to 20*h*). The two magnetic gap layers 40 and 40 are vertically symmetrically disposed in the magnetically equivalent fashion while sandwiching the magnetic body layer at the central portion of lamination. Moreover, four conductive pattern layers are disposed between the two magnetic gap layers 40 and 40. This implementation will be defined as Type C.

The laminated inductor 10 of the sixth implementation shown in FIG. 5D includes the magnetic gap layers 40 (5 μm) having relatively the small thickness, which are formed respectively in a space between a first layer and a second layer from the top and in a space between a first layer and a second layer from the bottom among the eight layers of conductive patterns (20*a* to 20*h*). The two magnetic gap layers 40 and 40 are vertically symmetrically disposed in the magnetically equivalent fashion while sandwiching the magnetic body layer at the central portion of lamination. Moreover, six conductive pattern layers are disposed between the two magnetic gap layers 40 and 40. This implementation will be defined as Type D.

Figure 6A:
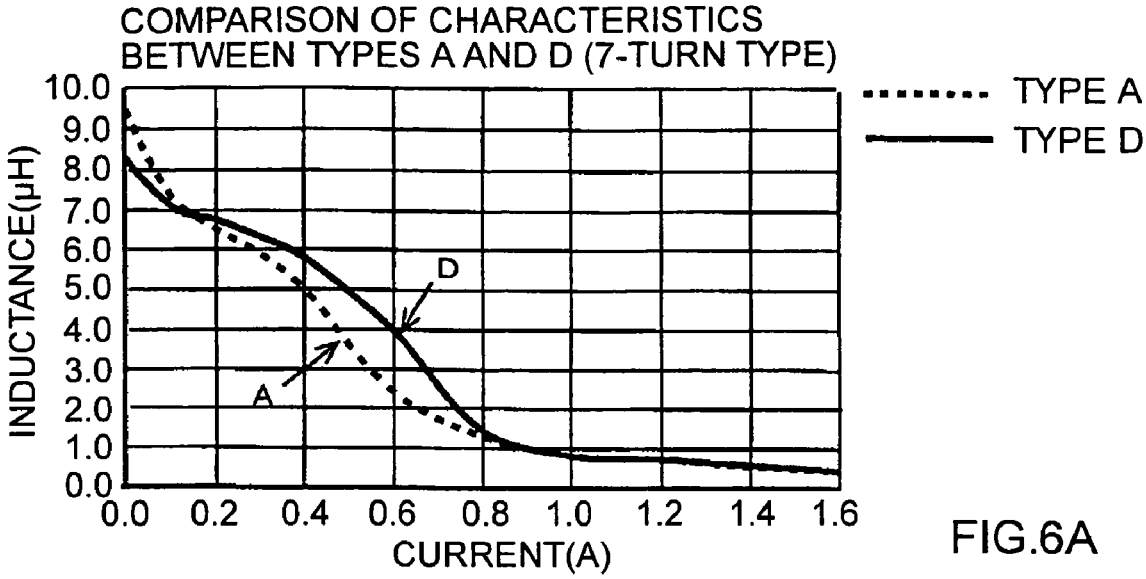
Figure 6B:
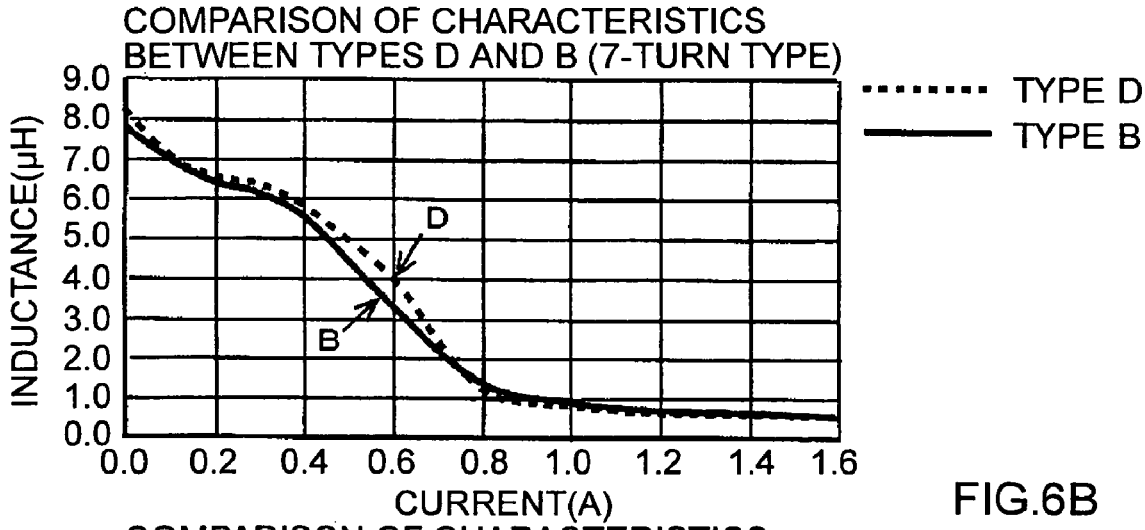
Figure 6C:
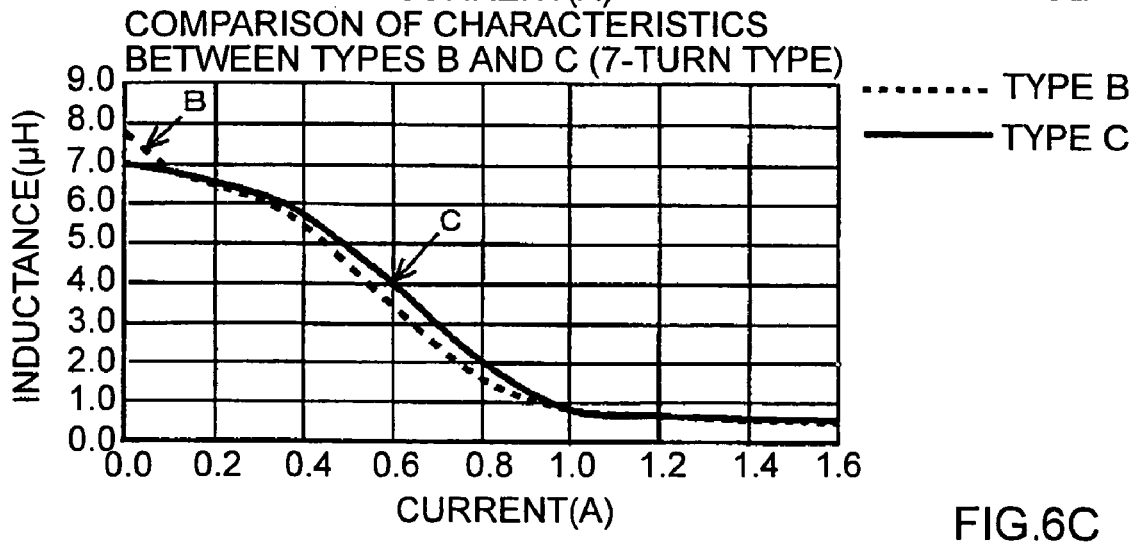

FIGS. 6A to 6C show current/inductance characteristics of the four Types A, B, C, and D, respectively. Of these drawings, FIG. 6A shows the characteristics of Type A and Type D, FIG. 6B shows the characteristics of Type D and Type B, and FIG. 6C shows the characteristics of Type B and Type C, respectively.

As a result of verification of the respective characteristic diagrams, Types B, C, and D (the fourth to sixth implementations) show smaller inductance variation in a small current region and achieve favorable characteristics having relatively gentle inductance variation in the entire current regions within the rated range as compared to Type A (the comparative example). Meanwhile, in comparison among Types B, C, and D (the fourth to sixth implementations), it was possible to achieve excellent characteristics in the descending order of Type C (the fifth implementation), Type B (the fourth implementation), and Type D (the sixth implementation).

Figure 7A:
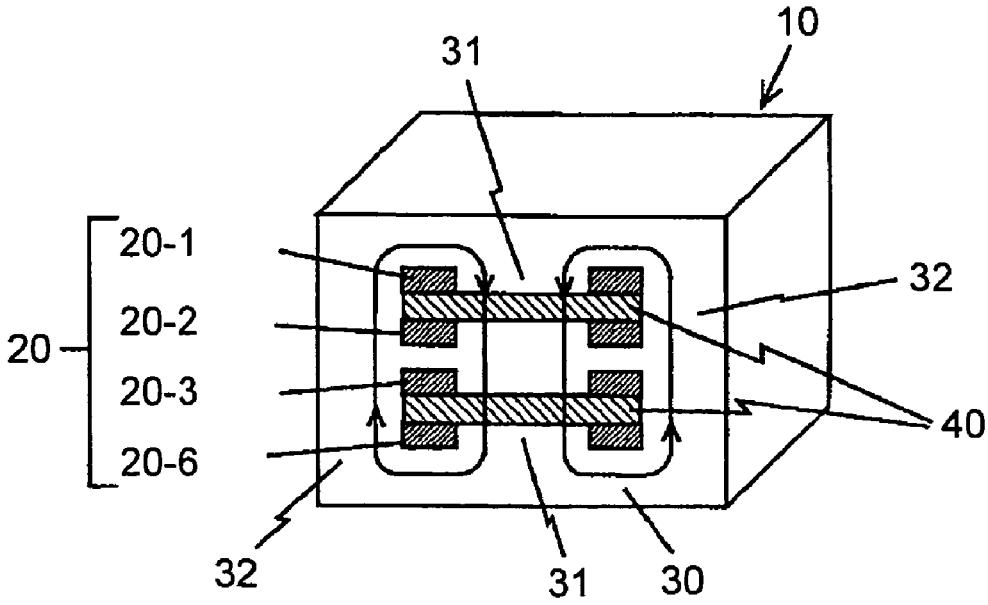
Figure 7B:
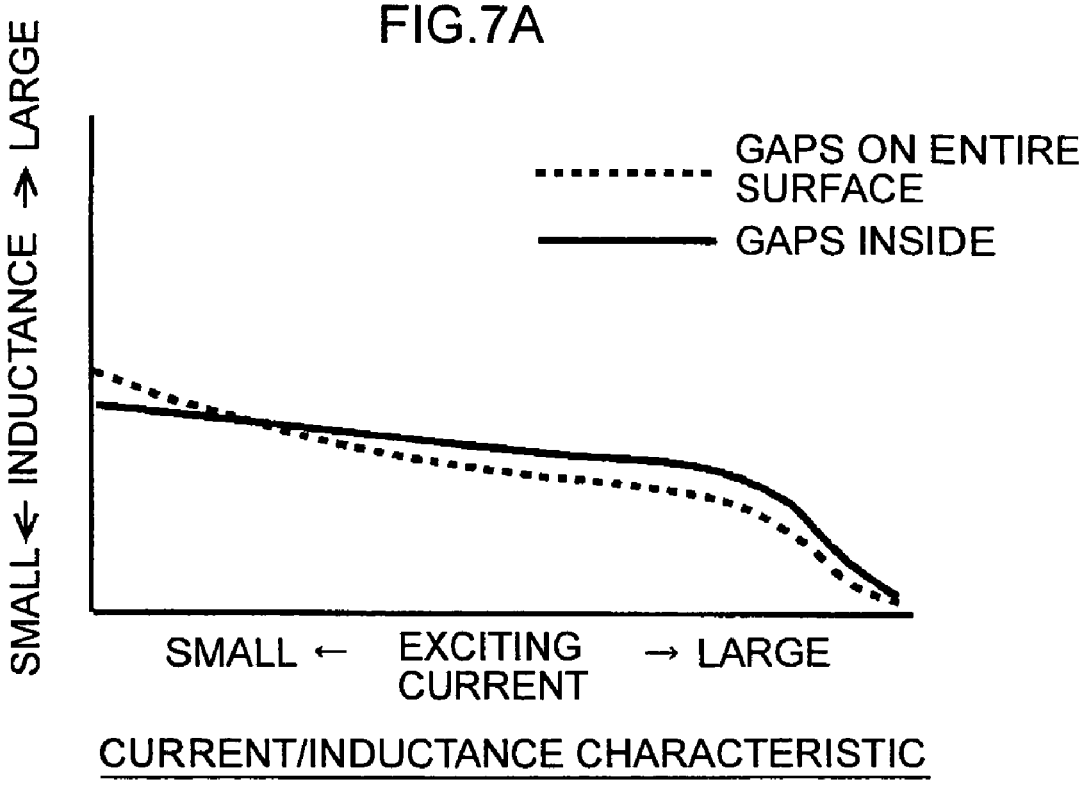

FIGS. 7A and 7B show a magnetic core type laminated inductor of a seventh implementation of the present invention. Of the drawings, FIG. 7A is a cutaway perspective view of the magnetic core type laminated inductor 10 which is enlarged in and emphasized on the thickness direction, and FIG. 7B shows a current/inductance characteristic thereof.

From a perspective of differences from the above-described implementations, in this seventh implementation, the magnetic gap layers 40 and 40 are formed on an overlapping surface with the spirally revolving conductive patterns 20 and on an inner side surface thereof, and side end surfaces of the magnetic gap layers 40 and 40 are surrounded by the magnetic bodies 30.

To the knowledge of the inventors, when the magnetic gap layer is formed so as to spread over the entire lamination surface, a magnetic flux leaks out of the side end surface of the magnetic gap layer 40 to the outside, and it is made clear that the leakage leads to noise generation. In a power supply circuit such as a DC-DC converter, a high frequency exciting current is applied to a transformer or a choke coil. Here, it is confirmed that an induction field by the high frequency exciting current leaks out of the side end surface of the magnetic gap layer 40 and causes noise generation.

On the contrary, according to the seventh implementation, the magnetic gap layers 40 and 40 are surrounded by the magnetic bodies 30 and are thereby magnetically shielded. Therefore, it is possible to surely block the magnetic flux leakage to the outside which causes the noise generation. At the same time, it is found out that the current/inductance characteristic is also improved so as to enhance the direct-current superposition characteristic as shown in FIG. 7B.

Figure 8A:
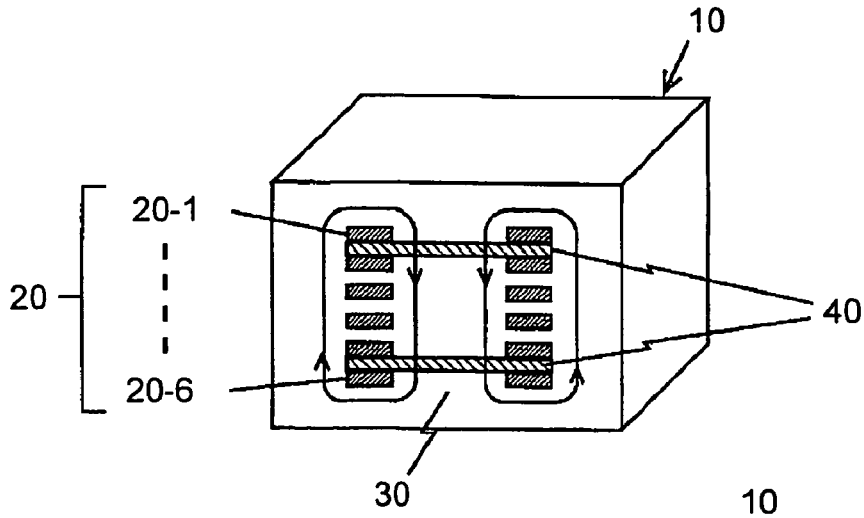
Figure 8B:
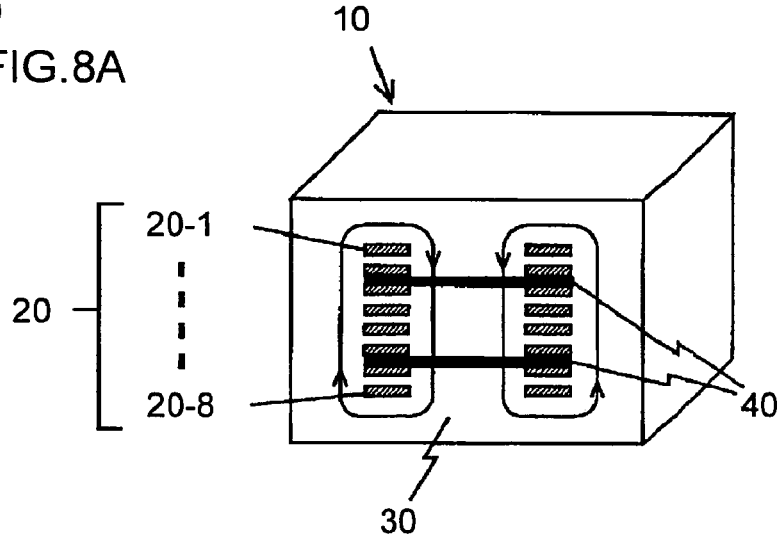
Figure 8C:
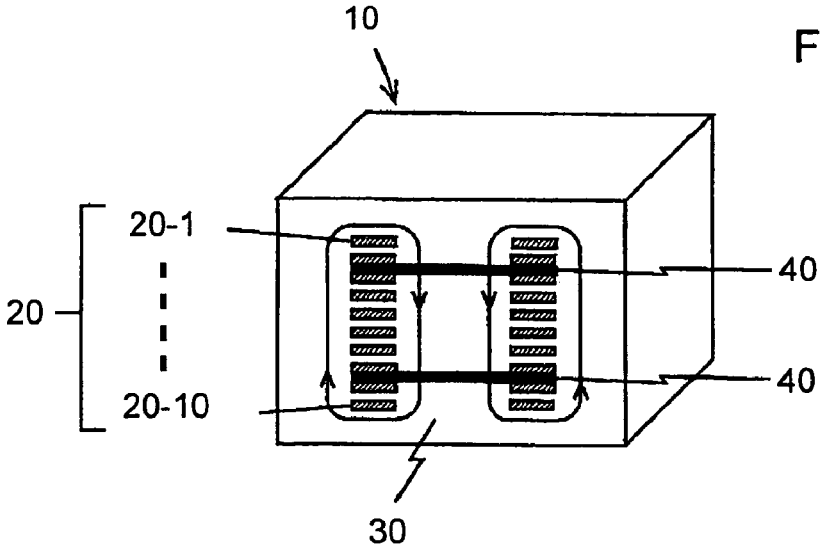
Figure 9A:
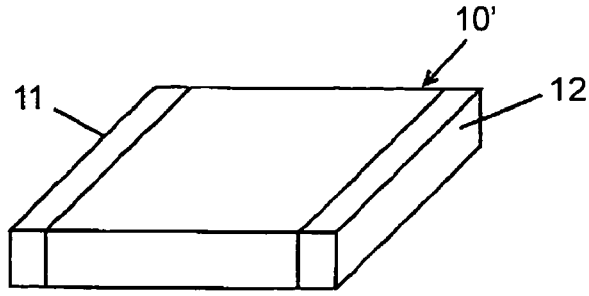
Figure 9B:
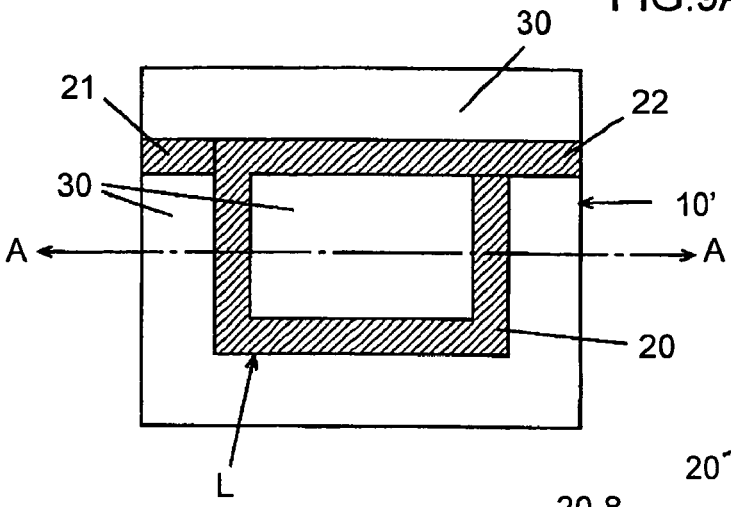
Figure 9C:
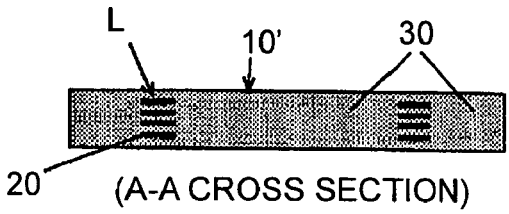
Figure 9D:
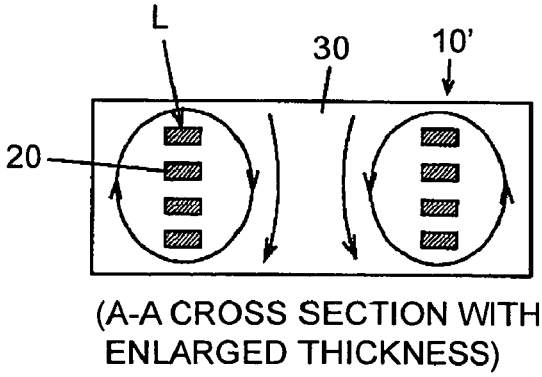

FIGS. 8A to 8C show magnetic core type laminated inductors of eighth to tenth implementations of the present invention. In terms of the drawings, FIGS. 8A to 8C respectively show cutaway perspective views of the magnetic core type laminated inductors 10 with enlargement in and an emphasis on the thickness direction.

The eighth to tenth implementations respectively represent modified examples of the seventh implementation. FIG. 8A shows the implementation of providing six layers of conductive patterns (20*a* to 20*f*) with two magnetic gap layers 40 and 40. FIG. 8B shows the implementation of providing eight layers of conductive patterns (20*a* to 20*h*) with two magnetic gap layers 40 and 40. Meanwhile, FIG. 8C shows the implementation of providing ten layers of conductive patterns (20*a* to 20*j*) with two magnetic gap layers 40 and 40 vertically symmetrically in the magnetically equivalent fashion. These implementations can also achieve the above-described effect.

Although the present invention has been described based on the representative implementations, the present invention allows various aspects other than the foregoing. For example, the laminated magnetic bodies 30, the conductive patterns 20 of the coil, and the magnetic gap layers 40 may be formed into planar patterns different from the rectangular patterns, including circular patterns, elliptical patterns, and the like.

According to the above-described implementations of the present invention, it is possible to provide a magnetic core type laminated inductor which can ensure a large rated current capable of assuring an inductance value equal to or above a given level, and achieve a favorable characteristic of relatively gentle variation of inductance in the entire current region within the rated range. In this way, the inductor can obtain a favorable direct-current superposition characteristic, and perform correct measurement and inspection at a small current. These features of the inductor are suitable for application to a micro DC-DC converter in a mobile information device such as a mobile telephone, which is configured to convert a power supply voltage obtained from an internal battery into a given circuit operating voltage.

Although the implementations of the present invention have been described in detail, it should be understood that various changes, substitutions and alterations can be made therein without departing from spirit and scope of the inventions as defined by the appended claims.

What is claimed is:

1. A magnetic core type laminated inductor comprising:

electrically insulating magnetic bodies;

conductive patterns laminated with the magnetic bodies, the conductive patterns overlapping in a lamination direction, in which the electrically insulating magnetic bodies and the conductive patterns are laminated, in the magnetic bodies and forming a single coil revolving spirally, an axial direction of the spiral coil being along the lamination direction, the magnetic bodies forming a closed magnetic circuit guiding annularly a magnetic field from the coil;

magnetic gap layers interposed between layers of the conductive patterns in the lamination direction, wherein the layers of conductive patterns directly engage the magnetic gap layer without a magnetic body layer interposed therebetween, the magnetic gap layers are formed separately in a plurality of layers mutually distant from each other while sandwiching a magnetic body in the lamination direction, the plurality of magnetic gap layers are disposed symmetrically in the lamination direction relative to a central portion of lamination in a magnetically equivalent fashion, and the respective magnetic gap layers are interposed with at least two layers of the conductive patterns between the magnetic gap layers.

2. The magnetic core type laminated inductor of claim 1 wherein the magnetic body layer is located at the central portion of lamination, and the plurality of magnetic gap layers are disposed symmetrically in the lamination direction in the magnetically equivalent fashion while sandwiching the magnetic body layer at the central portion.

3. The magnetic core type laminated inductor of claim 1, wherein the conductive patterns which form the coils are made of the layers in an even number, and the plurality of magnetic gap layers are disposed symmetrically in the lamination direction in the magnetically equivalent fashion respectively above and below the magnetic body layer at the central portion which vertically bisects the conductive pattern layers in the even number.

4. The magnetic core type laminated inductor of claim 1, wherein the coil is made of the conductive patterns of four layers, and the magnetic gap layers are disposed respectively between first and second layers of the conductive patterns and between third and fourth layers of the conductive patterns.

5. The magnetic core type laminated inductor of claim 1, wherein the magnetic bodies are made of a ferrite magnetic material.

6. The magnetic core type laminated inductor of claim 1, wherein the magnetic gap layer is made of a non-magnetic material.

* * * * *